United States Patent [19]

Veale

[11] 4,268,177

[45] May 19, 1981

[54] PAPER THICKNESS ADJUSTING MECHANISM FOR IMPACT PRINTER

[75] Inventor: John R. Veale, Manhattan Beach, Calif.

[73] Assignee: Plessey Peripheral Systems, Irvine, Calif.

[21] Appl. No.: 956,738

[22] Filed: Nov. 1, 1978

[51] Int. Cl.[3] ..... B41J 11/20

[52] U.S. Cl. ..... 400/55; 400/59; 400/144.3

[58] Field of Search ..... 400/55, 56, 57, 59, 400/60, 144.2, 144.3

[56] References Cited

U.S. PATENT DOCUMENTS

| | | | |
|---|---|---|---|
| 3,286,807 | 11/1966 | Decker | 400/376 |
| 3,349,885 | 10/1967 | Stuiber et al. | 400/376 |
| 3,356,199 | 12/1967 | Robinson | 400/144.3 |
| 3,384,216 | 5/1968 | Thayer | 400/144.3 |
| 3,623,587 | 11/1971 | Link | 400/375.2 |
| 3,750,792 | 8/1973 | Liles | 400/56 X |
| 3,935,936 | 2/1976 | Wilczewski | 400/55 |
| 3,960,256 | 6/1976 | Bickoff et al. | 400/55 X |
| 3,983,803 | 10/1976 | Thomas et al. | 400/56 X |
| 4,010,834 | 3/1977 | Linder | 400/55 X |
| 4,023,662 | 5/1977 | Perucca | 400/59 X |
| 4,063,630 | 12/1977 | Crowe et al. | 400/59 X |
| 4,086,997 | 5/1978 | Wu | 400/57 |

*Primary Examiner*—Ernest T. Wright, Jr.
*Attorney, Agent, or Firm*—Knobbe, Martens, Olson, Hubbard & Bear

[57] ABSTRACT

An apparatus adjusts the angular orientation of a moving carriage carrying a type font in a true font, stop-to-print, moving head high speed printer. This rotational adjustment provides a simple but accurate paper thickness adjustment which simplifies the printer construction and increases its reliability.

4 Claims, 5 Drawing Figures

PAPER THICKNESS ADJUSTING MECHANISM FOR IMPACT PRINTER

BACKGROUND OF THE INVENTION

The present invention relates to high speed printers having moving heads or carriages which carry printing fonts such as rotating daisy wheels. More particularly, the invention relates to apparatus utilized for adjusting such printers to accept a variety of paper thicknesses such as by making one or more carbon copies.

In the prior art, it has been recognized that with an impact printer, for example, a daisy wheel printer, wherein the printing elements are impacted by a hammer mechanism, in order to provide uniform print quality with varying paper thicknesses, it is necessary to adjust the platen location so that the surface of the paper to be printed remains a predetermined distance from the daisy wheel. Thus, it has been recognized that, without such an adjustment, thick forms placed in the printing mechanism can bind against the daisy wheel and destroy this mechanism which rotates at extremely high speed. In addition, the hammer mechanism is designed to operate optimally with a given reciprocating distance, which distance would change with varying paper thicknesses if no adjustment were included in the printer.

In order to accommodate such varying thicknesses of paper stock or varying numbers of copies, the prior art has typically mounted the platen and its associated roller assemblies on a movable sub-frame which could be adjusted on the main printer frame. This, of course, requires an adjustment at both ends of the platen to a uniform extent, which in turn typically requires relatively complicated linkages.

In addition, the requirement that the entire platen be moved, requires special guideways for this sub-frame to assure that the platen remains rigid in each of its adjusted positions. This adjustment technique adds substantial complication to the mechanics of a high speed printer, and thus adds to its cost.

It is believed that the alternative approach disclosed in the present patent application, which provides an adjustment of the carriage mechanism rather than the platen, has been avoided in the prior art because it is generally assumed that the carriage mechanism, which must move rapidly under servo motor control, requires firmly mounted guide rods to provide repeatable positioning. Thus, the prior art has uniformly adjusted the platen position, leaving the carriage mounting assembly and, in particular, the carriage guide rods, as a rigid portion of the printer frame to assure accurate tracking of the printer carriage.

SUMMARY OF THE INVENTION

The present invention provides a paper thickness adjustment for a high speed moving head printer by tilting the carriage assembly around a primary stationary guide rod. This primary stationary guide rod provides the accurate repeatable tracking which is required in such a printing mechanism, and supports the substantial forces generated during adjustment of the carriage position. A secondary guide rod is used for maintaining the rotational orientation of the carriage assembly around the primary guide rod, but this secondary guide rod is eccentrically mounted on the printer frame. Thus, by rotating the secondary guide rod about its eccentric mounts, its axis can be shifted to rotate the carriage assembly about the primary guide rod. This rotation occurs about an axis which is offset from the hammer impact point so that the rotation adjusts the distance between the hammer and daisy wheel on one hand, and the platen on the other hand.

The eccentric mounting of the secondary guide rod at both ends assures that, though adjustable, the guide rod will remain parallel to the primary guide rod in all configurations so that repeatable parallel movement of the carriage is not sacrificed. In addition, a ball and socket joint is utilized to connect the carriage assembly to the secondary guide rod so that the motion of the eccentrically adjustable guide rod, which is not tangential to the primary guide rod, that is, which is not tangential to the permitted axis of rotation of the carriage, may be tolerated by the system without affecting printing accuracy.

The use of the eccentrically adjustable secondary guide rod permits an extremely fine adjustment for paper thickness variations, since a relatively long lever arm may be attached to the secondary guide rod to rotate this rod through a few degrees at a time to effect a minor displacement of the print wheel and hammer toward or away from the printer platen.

These and other advantages of the present invention are best understood through the following detailed description with reference to the drawing, in which.

DETAILED DESCRIPTION OF THE PREFERRED EMBODIMENT

Figure 1:
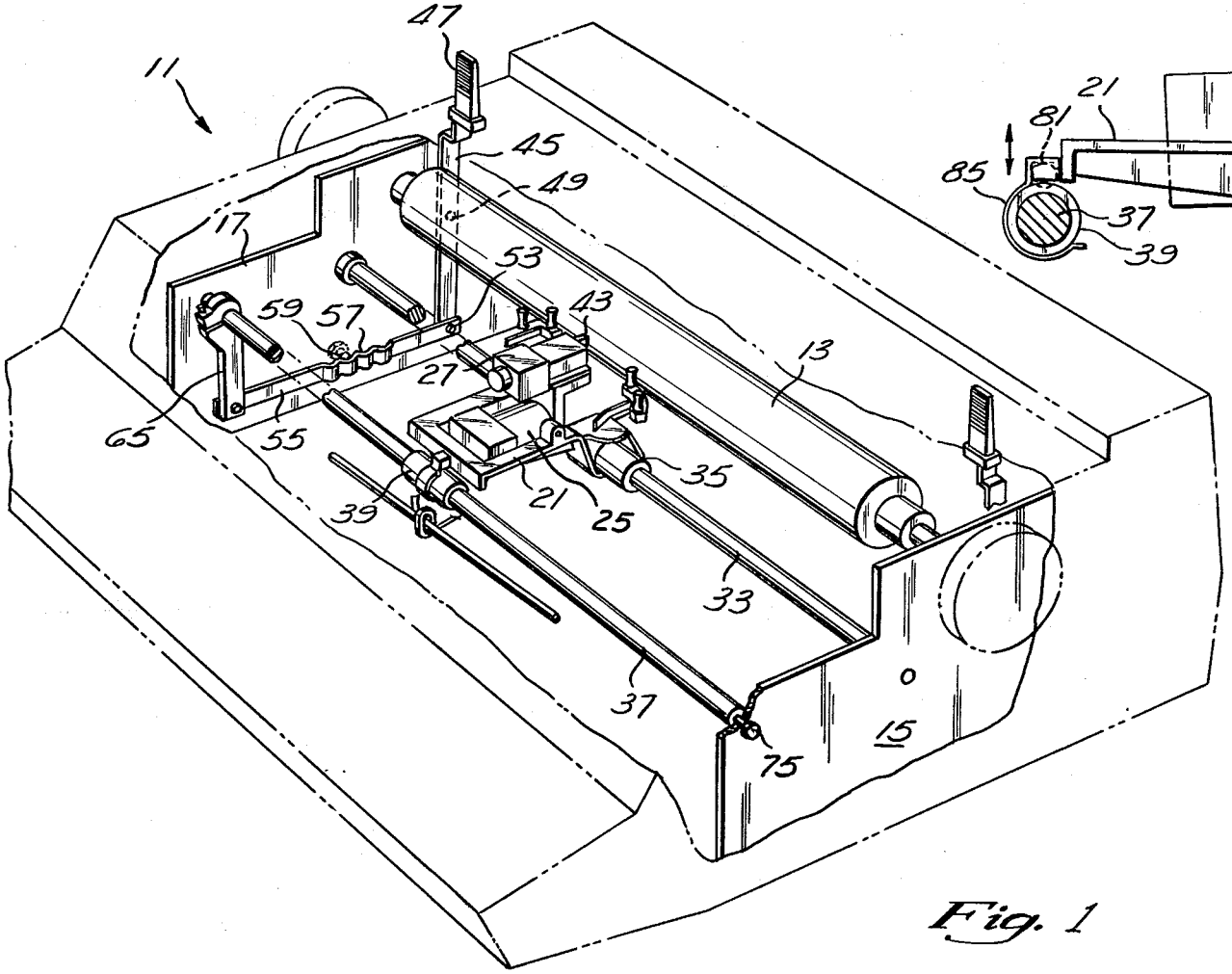
FIG. 1 is a perspective view showing the front of a printer incorporating the thickness adjustment of the present invention.

Referring initially to FIG. 1, the printer 11 of the present invention is shown with the outer covers partially cut away so that the adjustment mechanism of the present invention is better illustrated. The printer 11 includes a rotatable platen 13 which is journaled in a pair of side plates 15 and 17 which form a part of the main frame of the printer 11. These side plates 15 and 17 are interconnected by a plurality of frame cross members (not shown) to provide a rigid frame for supporting the various elements of the printer 11.

The printer 11 includes a carriage 21 which supports a daisy wheel printing disc 23 which rotates in accordance with the position of a motor 25 carried on the carriage 21. In addition, a hammer assembly 27 is supported on the carriage 21 and is used for impacting the printing elements (not shown) of the print wheel 23 against the platen 13, a ribbon 29 being interposed, to effect printing.

Those skilled in the art will recognize the printer 11 of FIG. 1 as a stop-to-print device. That is, the device rotates the print wheel 23 to a desired letter position, and adjusts the position of the carriage 21 utilizing a motor-driven cabling system (not shown) to fixed locations. When these systems are at rest, the hammer assembly 27 is energized to print a desired character. Because the device must be rapidly accelerated and decelerated between printing locations, high torque, high gain servo systems are utilized to provide movement of the various elements. Thus, the carriage 21 is subjected to substantial forces as it is driven along the platen 13 to print a line of characters.

The carriage 21 is supported on a principal guide rod 33 which is rigidly mounted on the side plates 15 and 17 at its opposite ends. A bearing 35 provides a close tolerance reciprocating interconnection with the guide rod 33 which permits accurate lateral adjustment of the carriage 21, even though the latter is subjected to high forces during the printing operation.

A secondary guide rod 37 provides rotational stability for the carriage 21 about the primary guide rod 33. Thus, a guide member 39 connected to the carriage 21 provides a close tolerance reciprocating fit with the secondary guide rod 37 and controls rotation of the carriage 21 about the principal guide rod 33.

Figure 2:
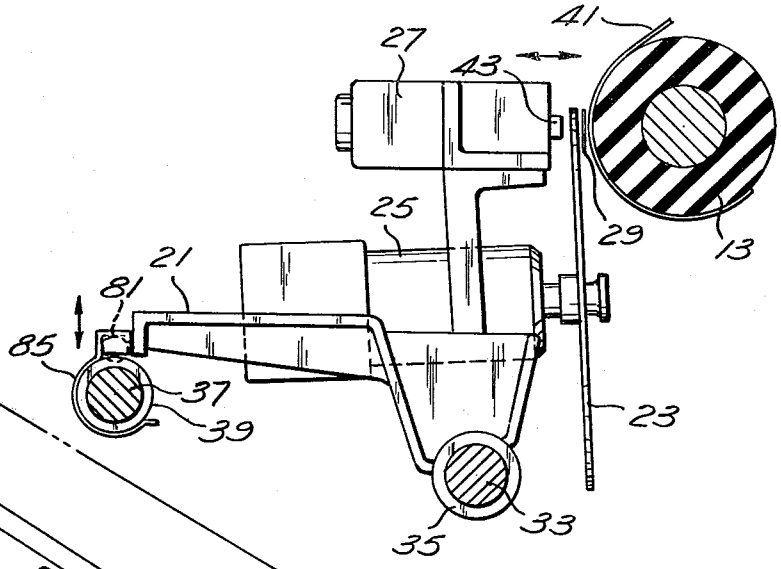
FIG. 2 is a schematic side elevation view showing the inter-relationship between the print wheel platen, hammer and paper shield (not shown) of the present invention.

Referring to FIG. 2, the inter-relationship of the primary guide rod 33, the platen 13, the hammer assembly 27, and the print wheel 23, will be explained. As suggested above, when paper or other record medium 41 of a given thickness is inserted around the platen 13, its thickness determines the distance which a striking element or anvil armature 43 of the hammer assembly 27 must move in order to impact a character on the print wheel 23 against the ribbon 29 and paper 41. A paper shield (not shown) protects the print wheel 23 (which rotates rapidly) from contact by the paper 41.

It is important that the movement of the anvil armature 43 of the hammer assembly 27 be relatively uniform as the thickness of paper 41 inserted around the platen 13 is changed. Thus, if the paper 41 thickness becomes too great, it may cause the print wheel 23 to crash against the anvil armature 43 during the wheel's rotation. Alternatively, if the paper 41 is too far from the print wheel 23, as when the paper 41 is quite thin, unsatisfactory printing will occur. The present invention assures that the distance between the print wheel 23 and the outer surface of the paper 41 may be maintained constant regardless of the thickness of the paper 41. This is accomplished by rotating the entire carriage 21 about the primary guide rod 33.

As is evident from FIG. 2, a rotation about the guide rod 33 pivots the entire carriage 21, generating a movement at the hammer assembly 27 and the upper perimeter of the print wheel 23 (the point of impact) toward or away from the platen 13 which is stationary. The ribbon 29 is guided on the carriage assembly, and its position is therefore adjusted at the same time.

Figure 3:
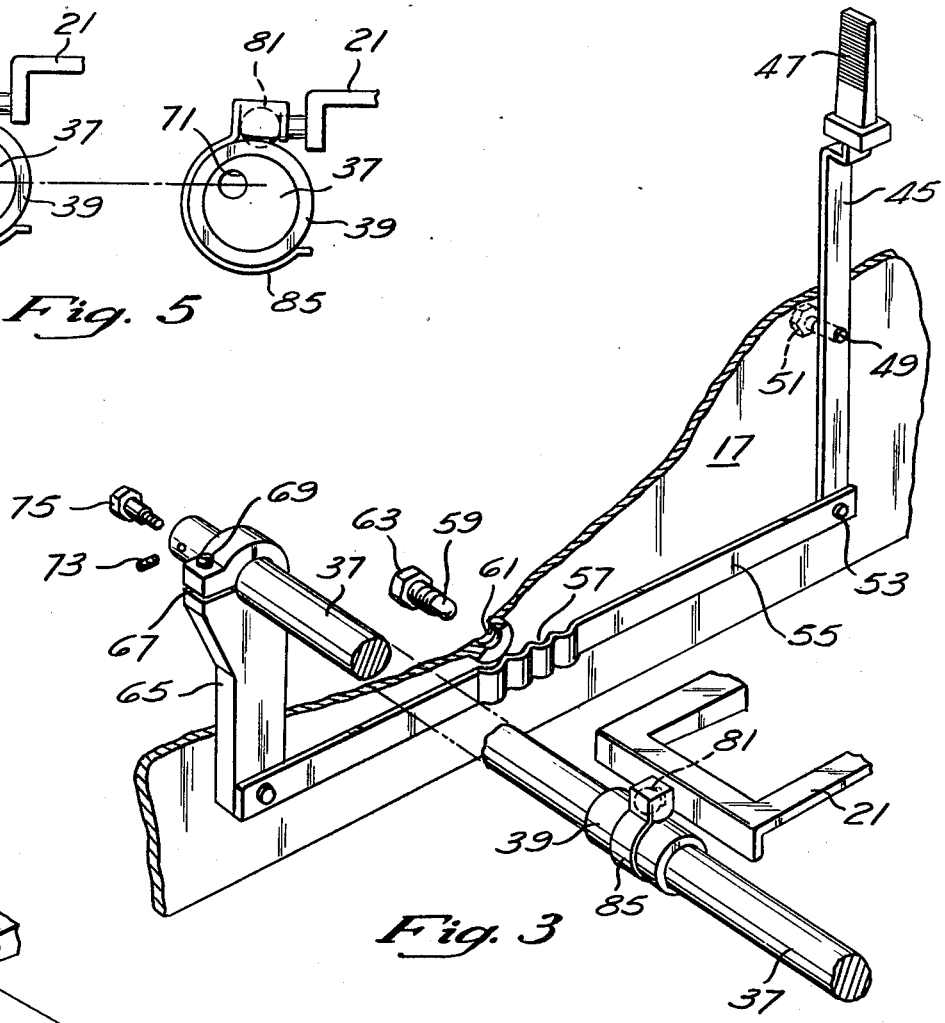
FIG. 3 is an exploded perspective view showing the mounting arrangement of the adjusting mechanism for the secondary guide rod in relationship to the main frame side memeber.

Referring now to FIGS. 1 and 3, the thickness adjustment lever arm and its mounting will be described. FIG. 3, it will be recognized, shows a view of the side plate 17 from the outside of the printer 11 and removed from the remaining frame members. A vertical thickness adjustment lever arm 45 supports a handle 47 and is journaled about a screw 49 which is attached by a nut 51 to the side plate 17. This vertical adjustment lever arm 45 is rotatably rivetted at 53 to a horizontal slide bar 55, a portion of which is scalloped at 57 to provide plural detents. When attached to the side plate 17 and to the adjustable guide rod 37 (FIG. 1), the lever mechanism of FIG. 3 is positioned immediately adjacent the side of the plate 17. A detent index 59 is attached at an aperture 61 by a nut 63 to the side plate 17, and is biased against each of the plural detents 57, successively, as the horizontal slide bar 55 is moved laterally. Thus, the resilience of the horizontal slide bar 55 itself holds the scalloped portion 57 tightly against the detent index 59 so that plural detented adjustment locations are provided for the thickness adjustment.

As the lever arm 45 is pushed forward and backward, the horizontal slide bar 55 is reciprocated forward and backward along the side plate 17. The opposite end of this horizontal slide bar 55 is attached to a rotation lever 65 which is, in turn, attached by means of a split clamping aperture 67 and clamp screw 69 to one end of the adjustable guide rod 37. From FIGS. 1 and 3, it can be seen, therefore, that a forward and backward actuation of the handle 47 will provide a rotation of the adjustable guide rod 37 through plural detented angular positions.

Figure 5:
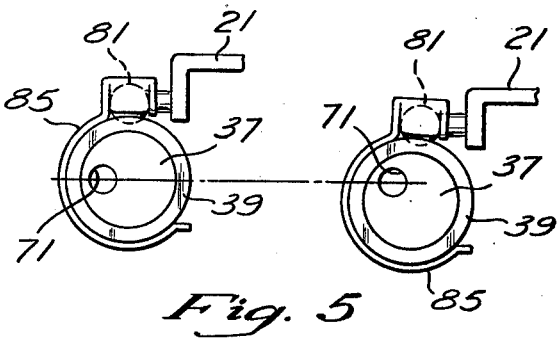
FIG. 5 is a schematic view showing two positions in the rotation of the secondary guide rod.
Figure 4:
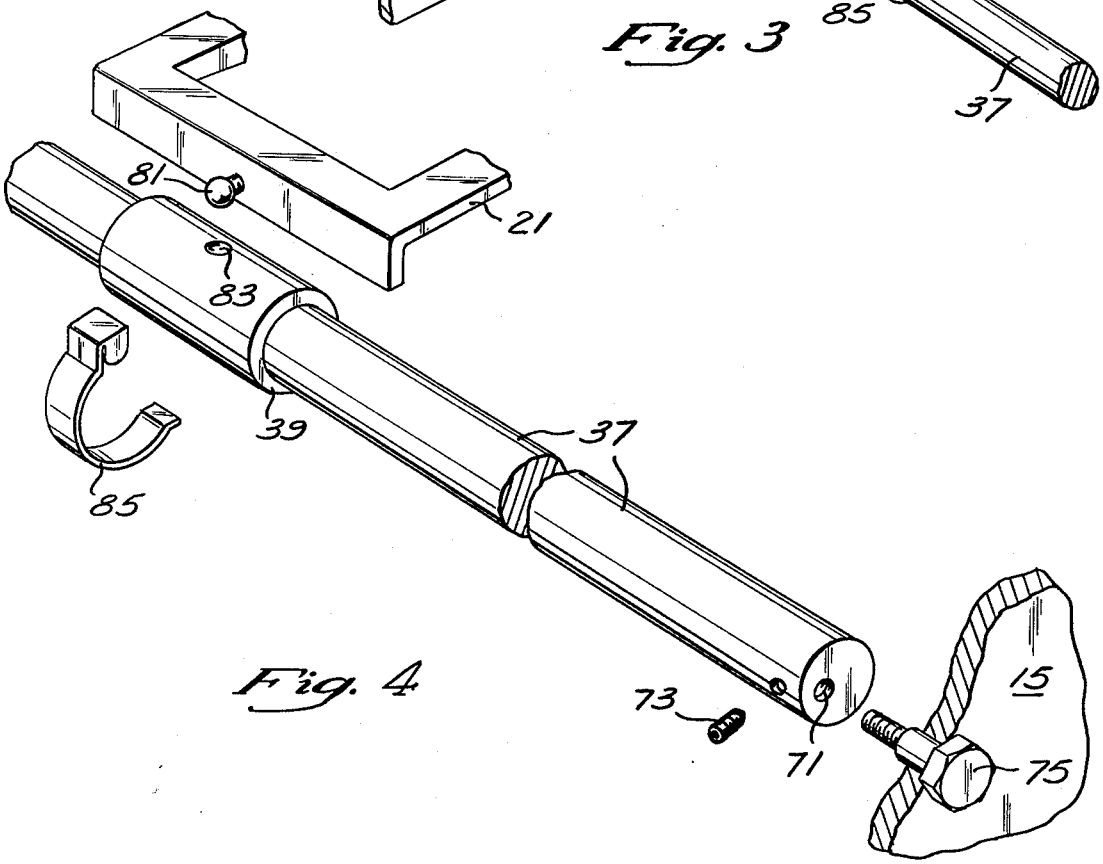
FIG. 4 is an exploded perspective view showing the mounting arrangement of the secondary guide rod on the main printer frame, as well as the interconnection between this guide rod and both the carriage mechanism and the adjustment mechanism of FIG. 3.

Referring now to FIG. 4, the effect of these plural angular positions may be described. The secondary adjustable guide rod 37 is provided with eccentric mounting holes 71 on its opposite ends, along with clamping screws 73. This guide rod 37 is mounted by a pair of screws 75 on the opposite end plates 15 and 17 of the printer 11, and the screws 75 are locked by the screws 73. With the eccentric mounting holes 71 (both eccentric holes 71 are offset in the same radial direction relative the axis of the rod 37), it will be recognized that a rotation of the secondary guide rod 37 will effect an eccentric movement of the guide rod 37. This movement is illustrated in FIG. 5. If, at a starting position (to the left side of FIG. 5), the eccentric holes 71 are in the same horizontal plane as the axis of the rod 37, a maximum vertical adjustment with minimal horizontal motion can be provided when the rod 37 is rotated, as shown on the right side of FIG. 5. This position is selected as the center of rotation of the secondary guide rod 37 by the rotation lever 65.

As previously stated, the primary guide rod 33 rotatably supports the carriage 21. The carriage 21 includes a spherical ball joint member 81 along its forward edge. This ball joint member 81 seats within a spherical depression 83 on the top of the guide bushing 39 journaled around the secondary guide rod 37. A spring clip 85 firmly seats the ball joint member 81 into the depression 83 to accurately control the vertical movement of the forward end of the carriage 21. It can be seen that this assembly will permit a moderate amount of horizontal movement of the guide rod 37 during adjustment, since the bushing 39 will rotate slightly about the secondary guide rod 37, with the ball joint member 81 rotating within the spherical bushing depression 83.

The principal motion, however, is vertical, and this motion rotates the carriage 21 about the guide rod 33 to accomplish the adjustment described in reference to FIG. 2.

It can be seen from the previous description that a very substantial movement of the handle 47 will effect only a very slight movement of the hammer assembly 27 and print wheel 23 toward or away from the platen 13, and thus very accurate adjustments can be made for changes in paper thickness, detented on a relatively large scale to make the system easy to adjust. The extent of adjustment, for a given motion of the handle 47 is primarily determined by the extent of eccentricity of the holes 71, which may be designed for any desired range of paper thickness.

The system of the present invention therefore accommodates the large forces present in a high speed printer by providing a stationary guide rod to absorb these forces. At the same time, by rotating the printing carriage about this stationary guide rod, and by offsetting the stationary guide rod from the impact location, an adjustment of the impact location can be accomplished. It has been found that the primary guide rod 33 is advantageously positioned as close as possible to a location directly beneath the impact location, so that rotation about this position will affect a movement of the hammer assembly 27 directly toward and away from the axis of the platen 13.

The system of the present invention permits substantial savings in cost by permitting a relatively simple adjustment rotationally of the carriage mechanism, rather than a linear sliding motion of both ends of the platen as has been required in the prior art. The invention also reduces the cost of the resulting printer, while increasing its ability to make accurate adjustments of the printing distance.

What is claimed is:

1. A high speed printer, comprising:

a frame;

a platen mounted in an axially fixed position on said frame;

a print head mounted on a carriage;

a pair of guide rods mounted on said frame for reciprocally supporting said carriage, one of said rods being adjustable relative to said frame in a direction tangential to the other one of said rods, said adjustability permitting said carriage to rotate about the other of said rods to alter the space between said print head and said platen to accommodate a variety of paper thicknesses in said printer; and means for compensating for movement of said one of said rods in a radial direction relative said other one of said rods to prevent alteration of the space between said print head and said platen due to such radial movement, said compensating means comprising:

a bushing rotatable on said one of said rods, said bushing having a depression therein;

a ball joint member attached to said carriage and rotatable in said depression on said bushing; and a clamp for securing said ball joint member to said bushing.

2. A high speed printer, comprising:

a frame;

a platen mounted in an axially fixed position on said frame;

a carriage;

a print head mounted on said carriage;

a pair of guide rods mounted on said frame for reciprocally supporting said carriage, one of said rods being adjustable relative to said frame in a generally vertical direction relative to the other one of said rods to alter the space between said print head and said platen to accommodate a variety of paper thicknesses in said printer; and means for compensating for movement of said one of said rods in a generally horizontal direction relative to said other one of said rods to prevent alteration of the space between said print head and said platen due to such horizontal movement, said compensating means comprising:

a bushing rotatable on said one of said rods;

a joint member mounted on said carriage; and a clamp for attaching said joint member to said bushing such that said generally horizontal movement of said one of said rods produces limited rotation of said bushing with respect to said one of said rods.

3. A high speed printer, comprising:

a frame;

a platen mounted in an axially fixed position on said frame;

a carriage;

a print head mounted on said carriage;

a pair of guide rods mounted on said frame for reciprocally supporting said carriage, one of said rods being adjustable relative to said frame in a direction tangential relative to the other one of said rods to alter the space between said print head and said platen to accommodate a variety of paper thicknesses in said printer;

a bushing rotatable on one of said rods; and means forming a joint on said carriage for connecting said carriage to said bushing, said bushing rotating relative to said one of said rods and said joint means pivoting relative to said bushing to provide means for compensating for movement of said one of said rods in a radial direction relative to said other one of said rods to prevent alteration of the space between said print head and said platen due to such radial movement.

4. A high speed printer, comprising:

a frame;

a platen mounted in an axially fixed position on said frame;

a carriage;

a print head mounted on said carriage;

a pair of guide rods mounted on said frame for reciprocally supporting said carriage, one of said rods being adjustable in a direction having both tangential and radial components relative to said frame and to the other one of said rods to alter the space between said print head and said platen to accomodate a variety of paper thicknesses in said printer;

a bushing mounted on one of said rods; and pivot means for attaching said bushing to said carriage, said pivot means rotating relative to said carriage to provide means for compensating for said radial movement of said one of said rods relative to the other one of said rods to prevent alteration of the space between said print head and said platen due to such radial movement.

* * * * *